US007392902B2

(12) United States Patent
Chang

(10) Patent No.: US 7,392,902 B2
(45) Date of Patent: Jul. 1, 2008

(54) SUSPENSION DEVICE WHICH PREVENTS A SUSPENDED TOOL FROM BURGLARY

(76) Inventor: Chi-Tsai Chang, No. 39, Sec. 3, Han Kou Rd., Taichung City (TW)

( * ) Notice: Subject to any disclaimer, the term of this patent is extended or adjusted under 35 U.S.C. 154(b) by 191 days.

(21) Appl. No.: 11/358,093

(22) Filed: Feb. 22, 2006

(65) Prior Publication Data

US 2007/0194204 A1 Aug. 23, 2007

(51) Int. Cl.
*B65D 75/00* (2006.01)

(52) U.S. Cl. ..... 206/349; 206/461; 206/806

(58) Field of Classification Search ..... 206/349, 206/461, 478, 486, 806
See application file for complete search history.

(56) References Cited

U.S. PATENT DOCUMENTS 6,425,482 B1 * 7/2002 Chiang ..... 206/349
6,837,373 B2 * 1/2005 Huang ..... 206/376
2003/0034316 A1 * 2/2003 Kao ..... 211/70.6
2004/0035731 A1 * 2/2004 Lee ..... 206/349

* cited by examiner

*Primary Examiner*—Jacob K Ackun, Jr.
(74) *Attorney, Agent, or Firm*—Jeong C. Lei

(57) ABSTRACT

A suspension device which prevents a suspended tool from burglary is disclosed. The suspension device comprises a suspension plate, and a clipping seat, connected to the bottom of the suspension plate, for clipping a tool, characterized in that the clipping seat has a hollow interior which is mounted with a rim mount directly encloses the external rim of the suspended tool such that the clipping tool can be locked and secured.

2 Claims, 4 Drawing Sheets

SUSPENSION DEVICE WHICH PREVENTS A SUSPENDED TOOL FROM BURGLARY

BACKGROUND OF THE INVENTION (a) Technical Field of the Invention

The present invention relates to suspension device, and in particular, a suspension device which holds a displayed suspended tool and secured with a bolt.

(b) Description of the Prior Art

In exhibition of working tools, the tools are generally covered or enclosed within a transparent box or compartment so as to isolate from contact with the public. However, the covered tools cannot be accurately inspected and therefore, the selection of the tools is not convenient. Further the enclosure of the tools increases the cost of production. Accordingly, it is an object of the present invention to provide a suspension device which can display a tool, and the device can prevent the suspended displayed tools from burglary.

SUMMARY OF THE INVENTION

The primary purpose of the present invention is to provide a suspension device which prevents a suspended tool from burglary comprising a suspension plate, and a clipping seat, connected to the bottom of the suspension plate, for clipping a tool, characterized in that the clipping seat has a hollow interior which is mounted with a rim mount directly encloses the external rim of the suspended tool such that the clipping tool can be locked and secured.

Yet still a further object of the present invention to provide a suspension device which prevents a suspended tool from burglary, wherein one side of the clipping seat is a hollow seat which allows a bolt to be locked to urge the rim mount for clipping a tool.

A further object of the present invention is to provide a suspension device which prevents a suspended tool from burglary, wherein one side of the clipping seat is an open space for holding a lug to lock and secure a tool.

A further object of the present invention is to provide a suspension device which prevents a suspended tool from burglary, wherein the diameter of the external rim of the rim mount is smaller than the inner diameter of the hollow edge of the clipping seat and the internal diameter of the hollow edge is varies to suit that of a tool.

Another object of the present invention is to provide a suspension device which prevents a suspended tool from burglary, wherein the external edge of the hole for the bolt is provided with a covering plate to cover the head section of the bolt.

Yet a further object of the present invention is to provide a suspension device which prevents a suspended tool from burglary, wherein a clipping slot is provided between the rim face of the clipping seat and the hollow seat, facilitating the removal of a suspended tool by cutting the clipping device.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
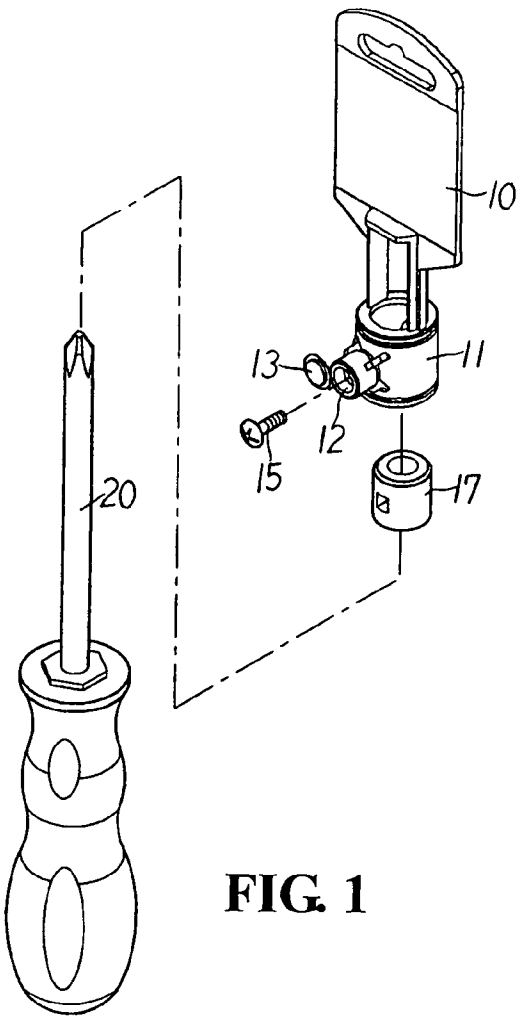
FIG. 1 is a perspective exploded view of a suspension device of the present invention.
Figure 2:
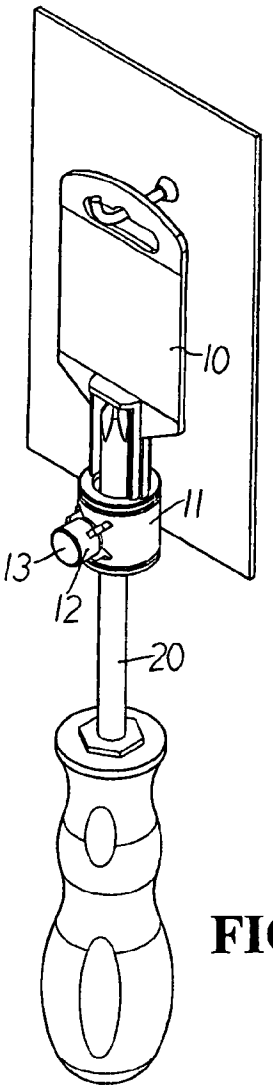
FIG. 2 is a schematic view showing the application of the suspension device of the present invention.
Figure 3:
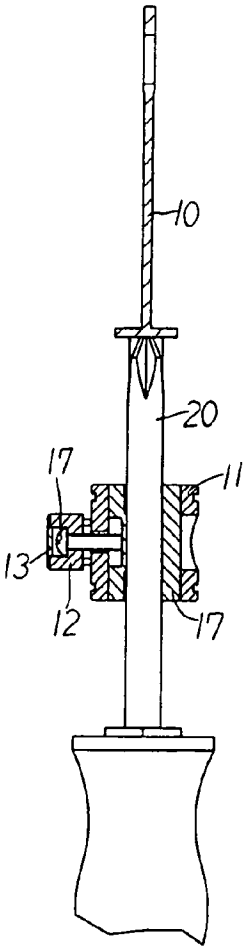
FIG. 3 is a plan view showing the locking of the suspension device of the present invention.

Referring to FIGS. 1 to 3, there is shown a suspension device comprising a suspension plate 10, which can be a rectangular shape or square or other shapes, and a hollow clipping seat 11 connected to the bottom of the suspension plate 10. One side of the seat body is provided with a tubular member 12 for securing and the the tubular member 12 is protruded until the external edge of the rim face of the clipping seat 11. On the clipping seat 11, a through hole is provided such that a bolt 15 can be directly mounted from the exterior side towards the interior. The hollow interior is first provided with a rim mount 17, which is made from plastic material, and the rim mount 17 is used to hold the external rim face of a tool 20, and allows the bolt 15 to urge directly to the rim mount 17. This will urge the clipping of the tool 20. The exterior of the hole seat 12 is mounted with a covering plate 13 so as to appropriately seal the hole seat 12 and prevents the bolt 15 from unloading, and therefore, the suspension device can prevent burglary of the suspended tool.

Figure 4A:
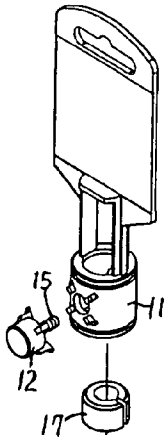
FIG. 4 is a perspective view showing the removing of a suspended tool to the suspension device of the present invention.
Figure 4:
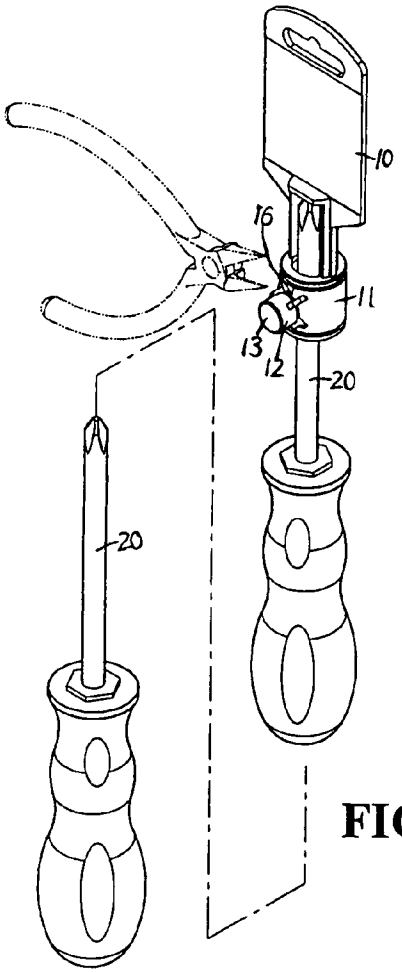

The external diameter of the rim mount 17 is smaller than the inner diameter of the clipping seat, and the internal diameter of the rim mount varies to adapt to the size of tool 20, and thickness of the rim mount 17 can be made thinner so as to facilitate urging of the tool, and the rim mount 17 can also be made into a C-shaped member having an open slit, as shown in FIG. 4, which is used for simple clipping of tool 20, and the clipping seat 11 can be made for holding any size tool 20. Thus, the suspension device has a wide application and therefore the cost of production is low.

The suspension design for the tubular member 12 facilitates unloading of tool 20 by cutting the connection point which can cut off the urging tubular member 12. Thus, the entire tool 20 can be easily withdrawn from the clipping seat

11. The bolt 15 can be tightened so that the rim mount 17 can be driven to clip the tool 20. In accordance with the present invention, the clipping operation is easy.

Figure 5:
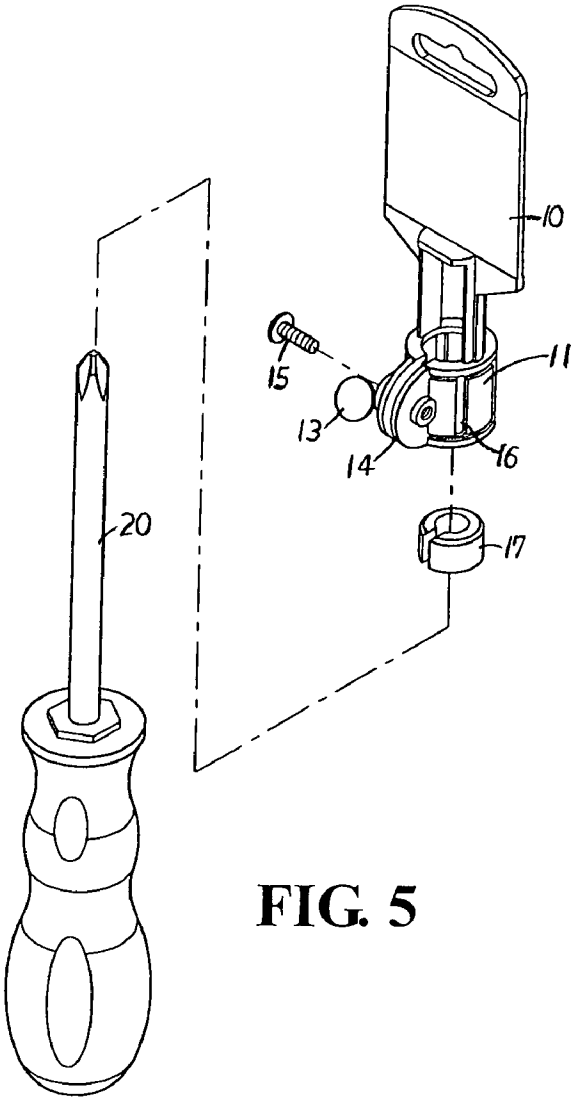
FIG. 5 is a perspective view showing another application of the suspension device of the present invention.
Figure 6:
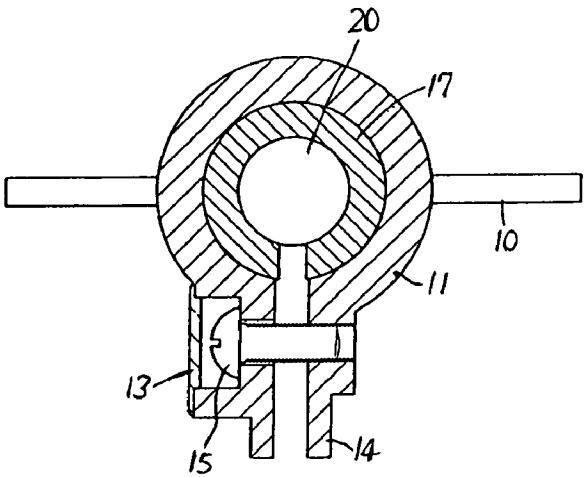
FIG. 6 is a plan view showing the locking of the suspension device of the present invention.
Figures 7, 7A:
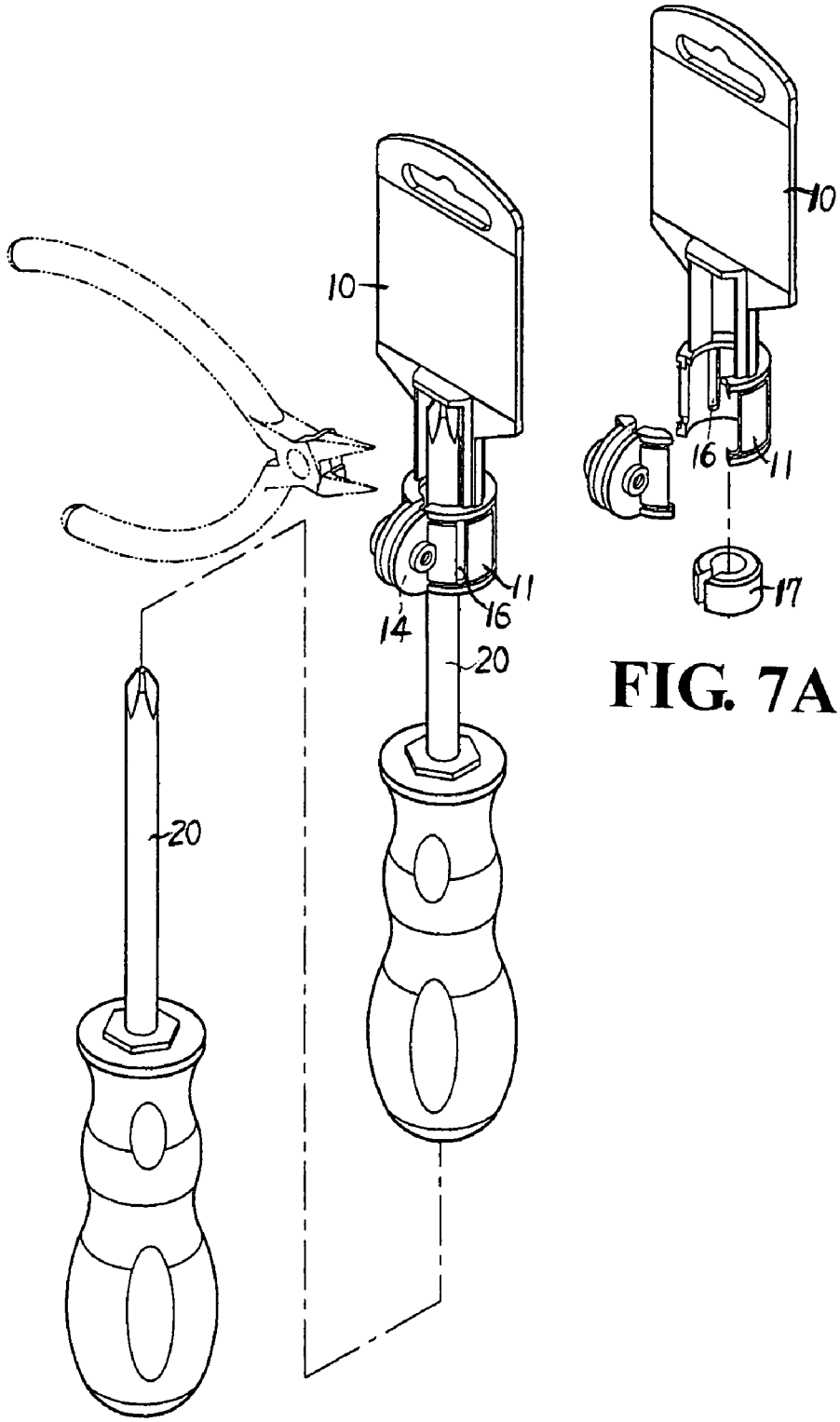
FIGS. 7 & 7A is a schematic view showing the removing of a suspended tool from the suspension device of the present invention.

As shown in FIGS. 5 to 7, one side of the clipping seat is a C-shaped opening, extending to form a lug 14 for locking, and generally, it is positioned at the rear side of the suspension device which ensures that the suspension device from damaging. The protruded lug 14 has a covering plate 13 for covering the hole such that the bolt 15 can be directly locked to the opening to clip the tool 20. The head section of the bolt will not be exposed after the covering plate 13 covers at the head section. As shown in FIGS. 7 & 7A, the consumer after purchasing the tool, can cut the connection at the upper and lower edge of the clipping slot 16 so that the clipping seat is opened and the tool 20 is withdrawn.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A suspension device comprising:

a suspension plate;

a hollow clipping seat connected to a bottom of said suspension plate, said hollow clipping seat having a seat body;

a tubular member mounted on a surface of said hollow clipping seat;

a plastic rim mount which is a C-shaped member having a recess, said rim mount being dimensioned to be fitted in said hollow clipping seat, a bolt extending through said tubular member and said hollow clipping seat to bear against said recess of said rim mount; and a covering plate adapted to said tubular member to cover a head of said bolt;

whereby when said bolt is turned through said tubular member and said hollow clipping seat to bear against said recess of said rim mount, said rim mount will contract to hold tight a tool inserted through said rim mount thereby keeping said tool in position and preventing said tool from being stolen.

2. The suspension device as claimed in claim 1, wherein said rim mount has an open slit.

* * * * *